US008522969B2

(12) United States Patent
Mason

(10) Patent No.: US 8,522,969 B2
(45) Date of Patent: Sep. 3, 2013

(54) APPLIANCE STORAGE AND ORGANIZER DEVICE

(76) Inventor: Cathy Mason, Little River, SC (US)

( * ) Notice: Subject to any disclaimer, the term of this patent is extended or adjusted under 35 U.S.C. 154(b) by 237 days.

(21) Appl. No.: 13/207,511

(22) Filed: Aug. 11, 2011

(65) Prior Publication Data

US 2013/0037443 A1 Feb. 14, 2013

(51) Int. Cl.
*B65D 69/00* (2006.01)

(52) U.S. Cl.
USPC ..... 206/234; 206/349; 206/701; 211/70.6; 280/47.19; 280/47.26; 280/47.35

(58) Field of Classification Search
USPC ..... 206/234, 320, 349, 372, 373, 488, 206/490, 701, 702; 132/286; 211/70.6; 439/501, 577; 280/47.19, 47.26, 47.34, 47.35, 280/79.3
See application file for complete search history.

(56) References Cited

U.S. PATENT DOCUMENTS 4,572,594 A 2/1986 Schwartz
4,871,074 A 10/1989 Bryson et al.
5,485,931 A * 1/1996 Barr, Jr. ..... 211/70.6
5,662,396 A 9/1997 Reeder et al.
5,917,694 A * 6/1999 Denny ..... 206/372
6,164,448 A * 12/2000 Schmutz et al. ..... 206/488
6,703,587 B2 * 3/2004 Sena et al. ..... 132/286
6,733,073 B2 5/2004 Whiteside et al.
6,769,554 B1 8/2004 Udofiah
6,817,372 B2 11/2004 Ennals et al.
6,844,494 B1 * 1/2005 Nevins ..... 439/490
7,198,511 B2 * 4/2007 Brennan, Jr. ..... 439/501
7,513,361 B1 * 4/2009 Mills, Jr. ..... 206/234
2001/0028208 A1 10/2001 Reilly
2007/0151899 A1 7/2007 Chun
2009/0139887 A1 6/2009 Furey et al.
2009/0173648 A1 7/2009 Geneva
2010/0084306 A1 4/2010 Chiang

* cited by examiner

*Primary Examiner* — Luan K Bui
(74) *Attorney, Agent, or Firm* — P. Jeff Martin; The Law Firm of P. Jeffrey Martin, LLC

(57) ABSTRACT

An appliance storage and organizer device, the device includes a housing having a plurality of walls forming an enclosure with a hollow interior. At least one of the plurality of walls includes a plurality of holes each adapted for receiving and retaining an electrical hair care appliance. The device further includes a means for organizing and preventing entanglement of an electrical cord(s) of an electrical appliance(s).

15 Claims, 5 Drawing Sheets

APPLIANCE STORAGE AND ORGANIZER DEVICE

RELATED APPLICATIONS

There are no previously filed, nor currently any co-pending applications, anywhere in the world.

BACKGROUND OF THE INVENTION

1. Field of the Invention

The present invention relates generally to electrical appliance organizers and, more particularly, to an appliance storage and organizer device.

2. Description of the Related Art

The prior art discloses various devices and apparatuses for holding, storing, and/or organizing electrical appliances, tools, implements, and the like. However, none of the prior art devices disclose, show, or teach an appliance storage and organizer device comprising a housing adapted for receiving and retaining electrical hair care appliances, a means for organizing and preventing entanglement of electrical cords of the electrical hair care appliances, and a plurality of hoods and retaining posts.

Accordingly, a need exists for an improved device for storing and organizing electrical appliances. The development of the appliance storage and organizer device fulfills this need.

A search of the prior art did not disclose any patents that read directly on the claims of the instant invention; however, the following references were considered related:

U.S. Pat. No. 5,917,694, issued in the name of Denny;
U.S. Pat. No. 6,769,554 B1, issued in the name of Udofiah;
U.S. Pat. No. 4,871,074, issued in the name of Bryson et al.;
U.S. Pat. No. 5,662,396, issued in the name of Reeder et al.;
U.S. Patent Application no. 2009/0139887 A1, published in the name of Furey et al.;
U.S. Pat. No. 6,817,372 B2, issued in the name of Ennals et al.;
U.S. Pat. No. 6,733,073 B2, issued in the name of Whiteside et al.;
U.S. Pat. No. 4,572,594, issued in the name of Schwartz;
U.S. Patent Application no. 2001/0028208 A1, published in the name of Reilly;
U.S. Patent Application no. 2007/0151899 A1, published in the name of Chun;
U.S. Patent Application no. 2010/0084306 A1, published in the name of Chiang; and
U.S. Patent Application no. 2009/0173648 A1, published in the name of Geneva.

Consequently, a need has been felt for an improved appliance storage and organizer device having a means for organizing and preventing entanglement of a number of electrical cords of a number of electrical appliances. This application presents claims and embodiments that fulfill a need or needs not yet satisfied by the products, inventions and methods previously or presently available. In particular, the claims and embodiments disclosed herein describe an appliance storage and organizer device comprising a housing which includes a plurality of walls forming an enclosure; at least one of the plurality of walls includes a plurality of holes each being sizably configured for receiving an electrical appliance; a means for organizing an electrical cord of an electrical appliance; a plurality of hoods each being associated with a respective one of the plurality of holes; a plurality of socket retainers; and a plurality of retaining posts, the device of the present invention providing unanticipated and nonobvious combination of features distinguished from the products, inventions and methods preexisting in the art. The applicant is unaware of any product, method, disclosure or reference that discloses the features of the claims and embodiments disclosed herein.

SUMMARY OF THE INVENTION

Briefly described according to one embodiment of the present invention, an appliance storage and organizer device is disclosed, wherein the appliance storage and organizer device comprises a housing comprising a plurality of walls forming an enclosure having a hollow interior. The housing more specifically comprises a front wall opposing a rear wall, a first end wall opposing a second end wall, a bottom wall, and a top wall.

At least one of the plurality of walls includes a plurality of holes defined therethrough, the plurality of holes being sizably configured for receiving and retaining an electrical appliance. Each of the plurality of holes includes an arcuate hood extending integrally from, or suitably affixed to, the mouth of each hole, the hoods each providing a guide support against which an appliance housing portion abuts.

A plurality of retaining posts is provided in order to enhance fixed securement of an electrical appliance when inserted through a respective hole.

A means for organizing an electrical cord of an electrical appliance is provided for organizing and preventing entanglement of an electrical cord of an electrical appliance, and for organizing and preventing entanglement of a number of electrical cords of electrical appliances, respectively, with a number of other electrical cords of electrical appliances.

An alternate embodiment is disclosed wherein the device of the present invention includes a plurality casters connected to at least one wall of the plurality of walls.

A second alternate embodiment is disclosed wherein the device of the present invention includes a handle suitably mounted to one of the plurality of walls, wherein handle is preferably a telescopic handle.

A third alternate embodiment is disclosed wherein the device of the present invention includes at least one drawer adapted and configured to be slidably opened/withdrawn from the housing and closed/inserted into housing without coming into contact with other device elements.

A fourth alternate embodiment is disclosed wherein the device of the present invention includes a means for mounting the device to a vertical surface.

A fifth alternate embodiment is disclosed wherein the device of the present invention includes at least one electrical outlet, wherein the at least one outlet is electrically connected to a power cord and a power cord plug. The power cord plug is receivable within a standard electrical wall outlet in order to electrically couple the at least one electrical outlet to a source of electrical power.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENT

Detailed Description of the Figures

Referring now to FIGS. 1-4, and 8, an appliance storage and organizer device 10 is shown, according to one embodiment of the present invention, wherein the appliance storage and organizer device 10, hereinafter referred to as "device 10", comprises a housing 20 comprising a plurality of walls 21 forming an enclosure 21*a* having a hollow interior 30. The plurality of walls 21 each having an inner surface and an outer surface. The housing 20 is manufactured from a lightweight, rigid material, preferably wood. Alternatively, housing 20 may be constructed of a lightweight, rigid material selected from the group comprising plastic, thermoplastic, metal or a metallic-plastic composite. Preferred plastic or thermoplastic materials include polyvinyl chloride (PVC), polypropylene, polyolefin, acrylonitrile-butadiene-styrene (ABS), polyethylene, polyurethane, polycarbonate, or blends thereof, and ABS/Nylon blend. In the event plastic is the selected fabrication material, the housing 20 may fabricated utilizing a common molding process such as injection molding, blow molding, extrusion, or other molding and fabricating methods.

Figure 3:
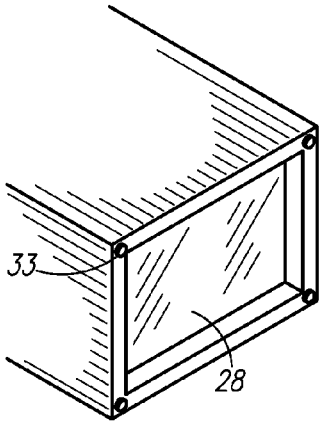
FIG. 3 is a bottom end perspective view of an appliance storage and organizer device illustrating a recessed bottom wall in accordance to one embodiment of the present invention.
Figure 4:
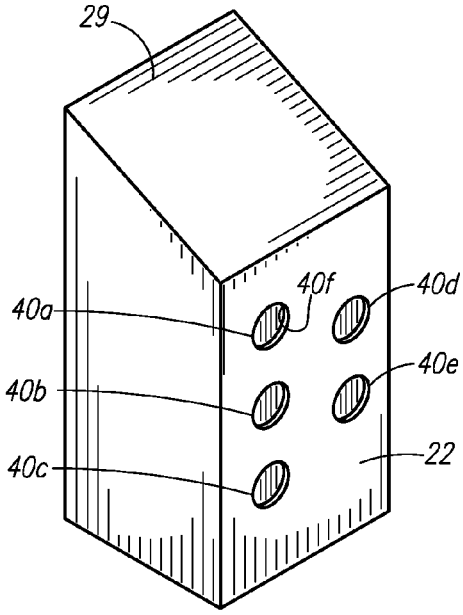
FIG. 4 is a right, frontal perspective view of the appliance storage and organizer device showing the plurality of holes disposed with a heat resistant sleeve, in accordance to one embodiment of the present invent.
Figure 5:
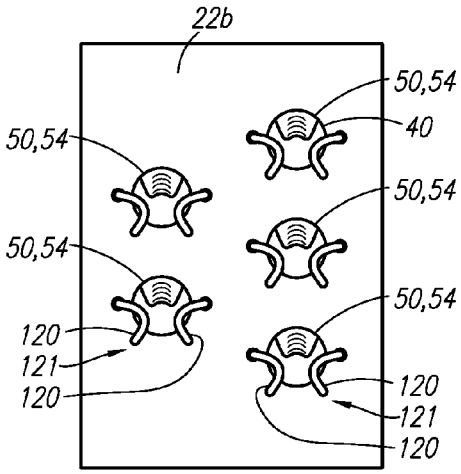
FIG. 5 is a bottom plan view of the front wall of the appliance storage and organizer device illustrating the plurality of hoods and retaining posts, according to one embodiment of the present invention.

The device 10, more specifically, comprises a housing 20 having a front wall 22 opposing a rear wall 24, a first end wall 26 opposing a second end wall 27, a bottom wall 28, and a top wall 29. Each of the front wall 22, rear wall 24, first end wall 26, second end wall 27, and/or the bottom wall 28 may be further defined as having a non-skid lower surface or base 32, or disposed with a non-skid element 33. The first end wall 26 and second end wall 27 are joined contiguously by the front wall 22, rear wall 24, bottom wall 28 and top wall 29, thereby forming the hollow interior 30. It is envisioned, in accordance to one embodiment, that bottom wall 28 may be recessed, as illustrated in FIG. 3. It is further envisioned that one wall 21 of the plurality of walls 21 may be detachably coupled to enclosure 21*a*, thereby providing user with quick, easy, and efficient access to hollow interior 30 when desired.

The top wall 29 is pitched at an angle from horizontal. The pitch of the top wall 29 may be described in a variety of ways, dependent upon the perspective of the observer. If viewed from the front wall 22, the pitch of the top wall 29 forms an incline from an upper edge 22*a* of front wall 22 to an upper edge 24*a* of rear wall 24. Conversely, if viewed from the rear wall 24, the pitch of the top wall 29 forms a decline from the upper edge 24*a* of rear wall 24 to the upper edge 22*a* of front wall 22.

The first end wall 26 and second end wall 27 each defines an acclivitous upper edge 26*a* and 27*a*, respectively, when viewed from the front wall 22 of housing 20, thereby facilitating the above-described pitch of top wall 29 when joined thereto.

The bottom wall 28 is preferably defined as being planar for balanced placement atop a horizontal surface 5, such as a countertop 6, vanity, and the like, thereby allowing for the housing 20 to be positioned stationary atop a desired horizontal surface 5.

At least one of the plurality of walls 21 includes a plurality of holes 40 defined therethrough. The plurality of holes 40 each includes a mouth 41 providing direct passage through hollow interior 30 to the bottom wall 28. The plurality of holes 40 may each be disposed with a heat resistant sleeve 40*f*. Alternatively, the housing 20 may be constructed of a rigid, heat resistant material. The wall 21 having the plurality of holes 40 further includes a plurality of apertures 90 defined therethrough and each of the apertures 90 being oriented adjacent each of the plurality of holes 40, respectively.

Figure 8:
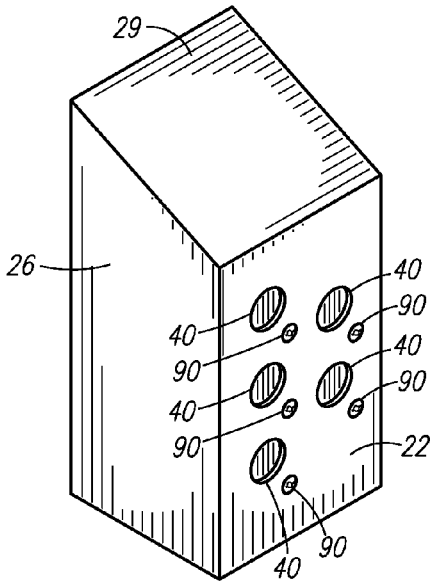
FIG. 8 is a right, frontal perspective view of the appliance storage and organizer device showing a plurality of apertures oriented adjacent, respectively, to each of the plurality of holes, in accordance to one embodiment of the present invention.
Figure 9:
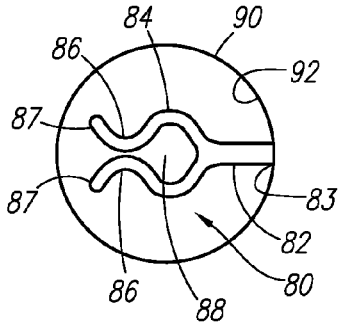
FIG. 9 is an enlarged elevational view of one of the plurality of apertures illustrating a socket retainer, according to one embodiment of the present invention.
Figure 10:
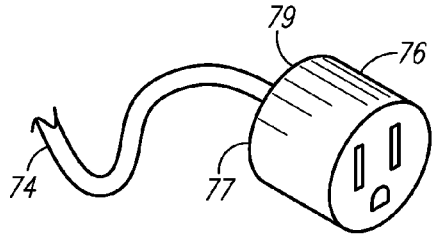
FIG. 10 is a partial perspective view of a cord and female socket of each cord storage and retractor mechanism, according to one embodiment of the present invention.
Figure 11A:
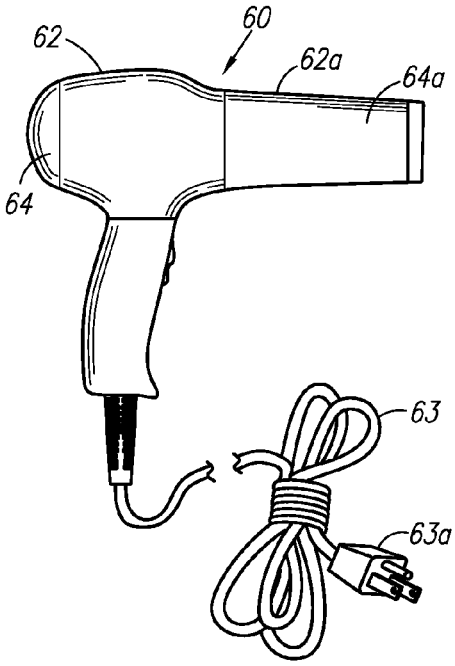
FIGS. 11A-11C are perspective views of various electrical hair care appliances.
Figure 11B:
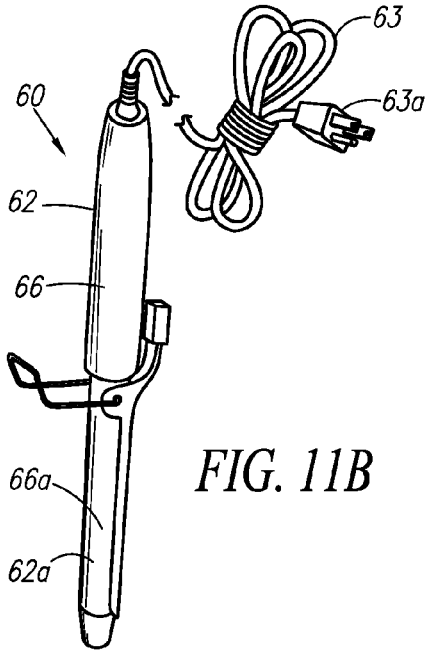
Figure 11C:
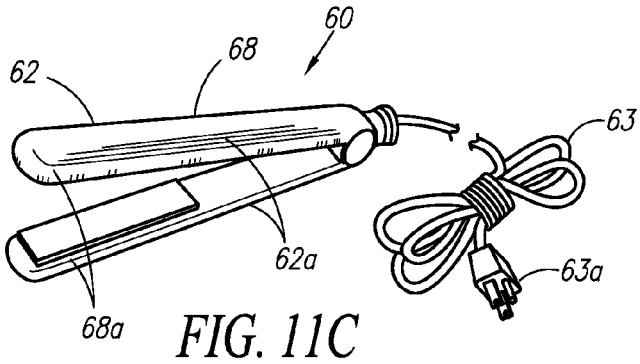

Referring now more specifically to FIGS. 1-6, and 11A-11C, in accordance to the preferred embodiment, the front wall 22 includes a plurality of holes 40 defined spatially therethrough. The front wall 22 further includes a plurality of apertures 90 defined therethrough and each of the apertures 90 being oriented adjacent each of the plurality of holes 40, respectively, as shown in FIG. 8. The apertures 90 are sized so as to allow an electrical plug to pass freely therethrough.

The plurality of holes 40 defined through front wall 22 may be of varying geometric shapes and sizes. For purposes of this disclosure, each of the plurality of holes 40 is sizably configured for receiving an electrical appliance 60, and more particularly, an electrical hair care appliance 62, wherein electrical hair care appliance 62 includes, but is not limited to, a hair dryer 64, hair curler 66, hair straightening iron or flat iron 68, and the like. The electrical appliances 60 each having an electrical cord 63 terminating into an electrical plug 63*a* for secured engagement with a standard electrical wall outlet (not shown) supplying electrical power.

Significantly, the holes 40 are dimensionally-shaped to closely conform to an outer configuration, respectively, of a particular appliance 62 housing portion 62*a*, i.e., the barrel 64*a* of a hair dryer 64, the rod 66*a* of a hair curler iron 66, and the legs 68*a* of a flat iron 68. For example, holes 40*a*-40*c* may be dimensionally-shaped and configured for receiving a hair dryer 64 in a semi-snug, conformational manner. By way of further example, holes 40*d*-40*e* may be dimensionally-shaped and configured for receiving a hair curler iron 66 and/or a flat iron 68 in a semi-snug, conformational manner. In accordance to the foregoing examples, holes 40*a*-40*c* have a greater diametric measure than a diametric measure of holes 40*d*-40*e*.

Figure 6:
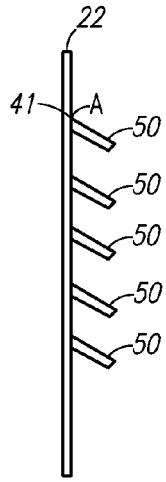
FIG. 6 is a left side elevational view of the front wall illustrating the hoods, according to one embodiment of the present invention.

According to one embodiment of the present invention, each of the plurality of holes 40 includes an arcuate hood 50 extending integrally from, or suitably affixed to, the mouth 41 of each hole 40 defined through the front wall 22 in order to provide a guide support 54 against which appliance 62 housing portion 62*a* abuts. The hood 50 extends angularly downward from an upper portion of the mouth 41 of each hole 40 and into the hollow interior 30. As shown in FIG. 6, hood 50 joins the mouth 41 at vertex A, forming an acute angle of approximately between 30°-80°, and preferably, approximately between 55°-62°. The hood 50 conjunctively serves as a means for guiding a selected appliance 62 through a selected hole 40 and for holding selected appliance 62 in removably-secured engagement with hood 50, thereby preventing dislodgement of appliance 62 until user desires to remove appliance 62 from its respective hole 40.

In order to enhance fixed securement of an appliance 62 when inserted through a respective hole 40, a plurality of retaining posts 120 are provided. The retaining posts 120 are provided in pairs 121, and wherein each pair 121 of retaining posts 120 is suitably mounted to a lower surface 22*b* of the front wall 22. The retaining posts 120 of each pair 121 are spaced in linear alignment and flank the perimeter of each hole 40 from opposing sides of the perimeter. Each post 120 of each pair 121 of retaining posts 120 defines an incurvate configuration being flexibly-resilient. Each pair 121 of retaining posts 120 extends downwardly appositional from the lower surface 22*b*. The pairs 121 of retaining posts 120 are each configured to frictionally engage the appliance 62 housing portion 62*a* of a selected appliance 62 as the appliance 62 housing portion 62*a* is inserted through a selected hole 40. As an outer surface of the appliance 62 housing portion 62*a* engages a pair 121 of retaining posts 120, the pair 121 of retaining posts 120 undergoes outward flexion, thereby causing a compression force to be applied by the pair 121 about the external circumferential sidewall of housing portion 62*a*. Upon removal of appliance 62 housing portion 62*a* from the selected hole 40, the pair 121 of retaining posts 120 flexibly returns to a resting orientation.

Referring now to FIGS. 7-11*c*, a cord storage and retractor mechanism 70 is disclosed. The cord storage and retractor mechanism 70 is configured for retracting the excess electrical cord 63 of an electrical appliance 60 through an aperture 90 in the housing 20.

Figure 1:
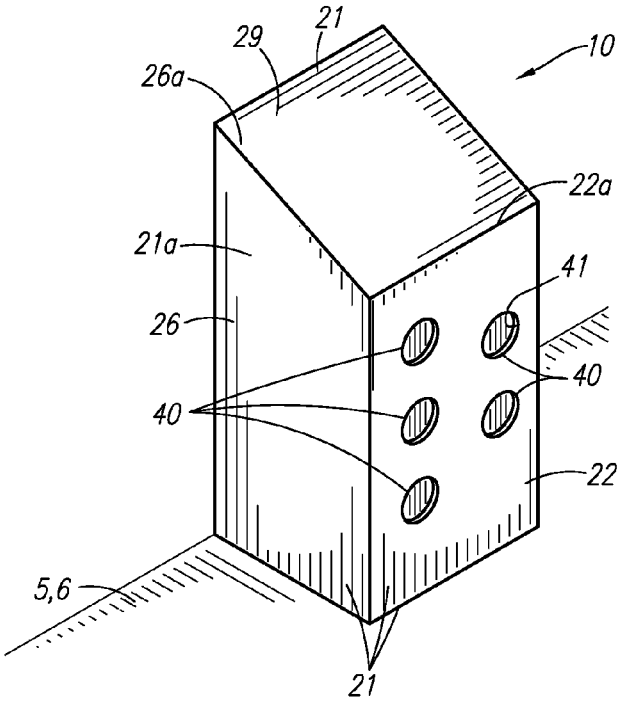
FIG. 1 is a right, frontal perspective view of an appliance storage and organizer device, according to one embodiment of the present invention.
Figure 2:
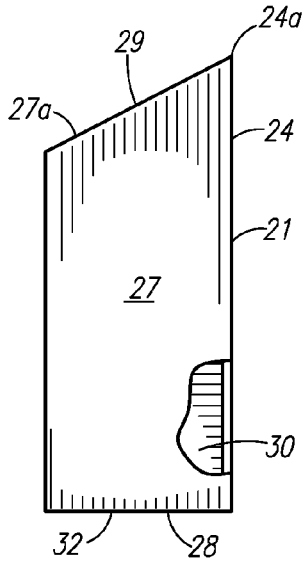
FIG. 2 is a left side elevational view of the device of FIG. 1 with a partial cut-away section, illustrating the hollow interior.
Figure 7:
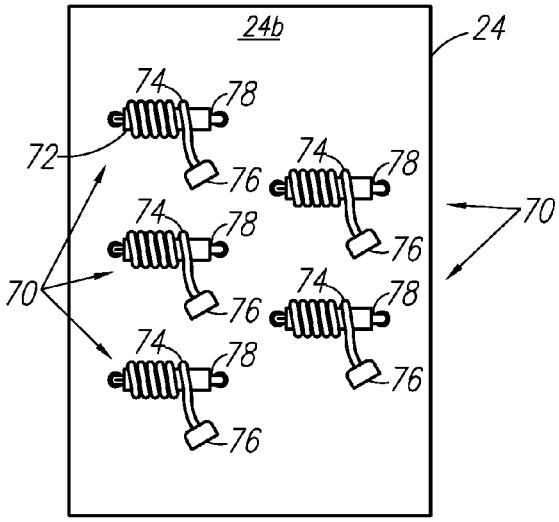
FIG. 7 is a top plan view of the rear wall illustrating a plurality of cord storage and retractor mechanisms, in accordance to one embodiment of the present invention.

In accordance to the preferred embodiment, the number of cord storage and retractor mechanisms 70 is equal to the number of holes 40 defined through housing 20. In an exemplary embodiment, the number of holes 40 is five and the number of mechanisms 70 is five (FIGS. 1 and 7, respectively). The cord storage and retractor mechanisms 70 are each configured so as to be substantially identical. Therefore, for purposes of brevity and obviating redundancy, only one cord storage and retractor mechanism 70 shall be described hereinbelow.

The cord storage and retractor mechanism 70 comprises a spring-biased drum or mandrel 72 for retracting an elongated cord 74 therearound. The elongated cord 74 has a free end affixed with a female socket 76 adapted for securably receiving an electrical plug 63*a* of an electrical appliance 60. The mandrel 72 is mounted to a wall 21 of housing 20 opposing the wall 21 through which a plurality of holes 40 is defined. Preferably, as shown in FIG. 7, the mandrel 72 is mounted via a bracket 78 to an inner surface 24*b* of the rear wall 24 of housing 20.

In order to provide user with quick, easy, and efficient access to the female socket 76 of each respective elongated cord 74 of the cord storage and retractor mechanism 70, a plurality of socket retainers 80 is provided. Each mechanism 70 of the plurality or sum of retractor mechanisms 70 has a respective socket retainer 80 associated therewith. For purposes of brevity and obviating redundancy, only one socket retainer 80 shall be described hereinbelow.

The socket retainer 80 is adapted and configured for allowing the elongated cord 74 to be removably attached thereto. The socket retainer 80 comprises a flexibly-resilient arm 82 having a lower end 83 suitably affixed or molded integral perpendicularly to an inner edge 92 of each respective aperture 90. Socket retainer 80 further comprises an upper end 84 bifurcating into a pair of curvilinear impingement arms 86 having divergently protruding ends 87. In a resting position, the impingement arms 86 are engaged in biased contact providing a neck retaining void 88 for receiving a neck 77 of the female socket 76 of the elongated cord 74. The neck retaining void 88 is defined as having a generally oval-shaped configuration. Each aperture 90 is sized so as to allow an electrical cord 63*a* and/or female socket 76 to pass adjacent of socket retainer 80 therethrough.

In order to facilitate removable attachment of elongated cord 74 to socket retainer 80, the neck 77 of female socket 76 is inserted perpendicularly between protruding ends 87 of impingement arms 86 and driven in a direction towards neck retaining void 88 with a force sufficient to open impingement arms 86 and until neck 77 is positioned within neck retaining void 88. Positioned inside neck retaining void 88, the neck 77 is constricted by the impingement arms 86, thereby removably attaching the elongated cord 74 to socket retainer 80. More specifically, once neck 77 is positioned inside neck retaining void 88, the impingement arms 86, being returnably resilient, flexibly re-engage biased contact with one another squeezing or compressing neck 77, thereby removably attaching the elongated cord 74 to socket retainer 80 in a manner which provides user with quick, easy, efficient, and unobstructed access to the female socket 76 for functional purposes and advantages to be described hereinbelow.

In addition, the impingement arms 86 provide an abutment against which a rear wall 79 of female socket 76 engages, thereby preventing retraction by elongated cord 74 on mandrel 72, until such retraction is desired by user. Thus, the curvilinear impingement arms 86 provide a means for retaining the elongated cord 74 (female socket 76) so as to prevent its retraction or wounding on mandrel 72 and out of the reach of user.

In order to organize the electrical cord 63 of an electrical appliance 60 after placing the electrical appliance 60 into a respective one of the holes 40, the electrical plug 63*a* of the electrical cord 63 is secured to the female socket 76 of the elongated cord 74. Female socket 76 is grasped and removed from socket retainer 80 by pulling female socket 76 through the protruding ends 87 of impingement arms 86. Female socket 76, with secured electrical cord 63 of appliance 60, is released, thereby facilitating retraction of electrical cord 63 and appliance 60 on a respective one mandrel 72. Thus, the cord storage and retractor mechanism 70 provides a means for organizing and preventing entanglement of an electrical cord 63 of an electrical appliance 60, and for organizing and preventing entanglement of a number of electrical cords 63 of electrical appliances 60 with a number of other electrical cords 63 of electrical appliances 60.

In the event user desires to employ the use of a desired electrical appliance 60, user pulls the electrical cord 63 of the desired electrical appliance 60, grasps the female socket 76, and inserts the neck 77 of female socket 76 perpendicularly between the protruding ends 87 of impingement arms 86 driving the neck 77 in a direction towards neck retaining void 88 until positioning neck 77 within the neck retaining void 88. Next, user detaches the electrical plug 63*a* of the desired electrical appliance 60 from the female socket 76 and secures electrical plug 63*a* to a wall outlet (not shown).

Figure 12:
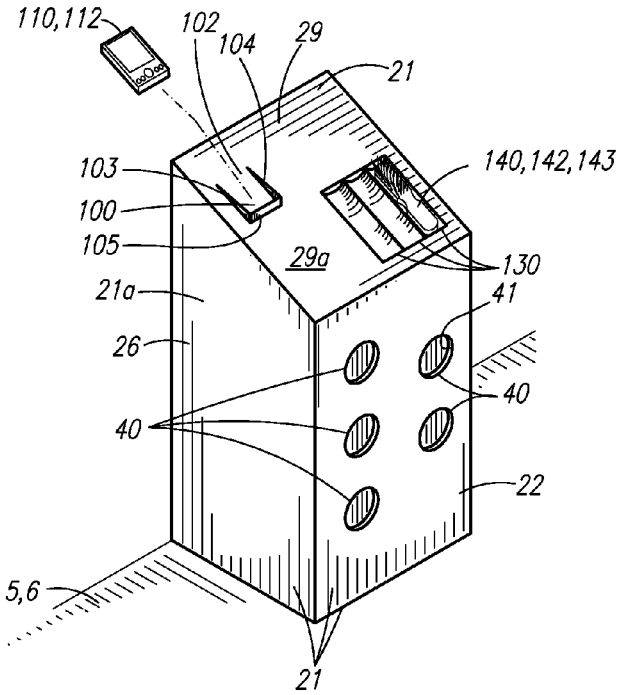
FIG. 12 is a right, frontal perspective view of the appliance storage and organizer device illustrating an interior space formed in one of the plurality of walls for accommodating and retaining a personal article, according to one embodiment of the present invention.

Referring now to FIG. 12, in accordance to one embodiment of the present invention, at least one of the plurality of walls 21 includes an interior space 100 having a shape and dimension for accommodating and retaining a personal article 110, i.e., cellular phone 112, a personal digital assistant (PDA) organizer, an iPOD, a portable radio, a pager, or other hand-held mobile electronic devices, in a semi-snug manner.

In an exemplary embodiment, the top 29 includes an interior space 100 having a shape and dimension for accommodating and retaining a cellular phone 112. The interior space 100 is defined as having a downwardly-sloped floor 102 from which two opposing sidewalls 103, 104 upwardly depend, the two sidewalls 103, 104 joined by a lower end wall 105 providing a retainer support for the cellular phone 112. The two sidewalls 103, 104 and end wall 105 extend upwardly from the floor 102 to a height being flush with an upper surface 29*a* of the top wall 29, as shown in FIG. 12.

In accordance to another embodiment of the present invention, at least one of the plurality of walls 21 (shown herein as top wall 29) includes a plurality of accessory retainer channels 130 for accommodating and retaining accessories 140, i.e., hair care accessories 142, such as a hair brush 143. The plurality of accessory retainer channels 130 may be defined as longitudinal recesses in the wall 21 and being aligned in series.

Figure 13:
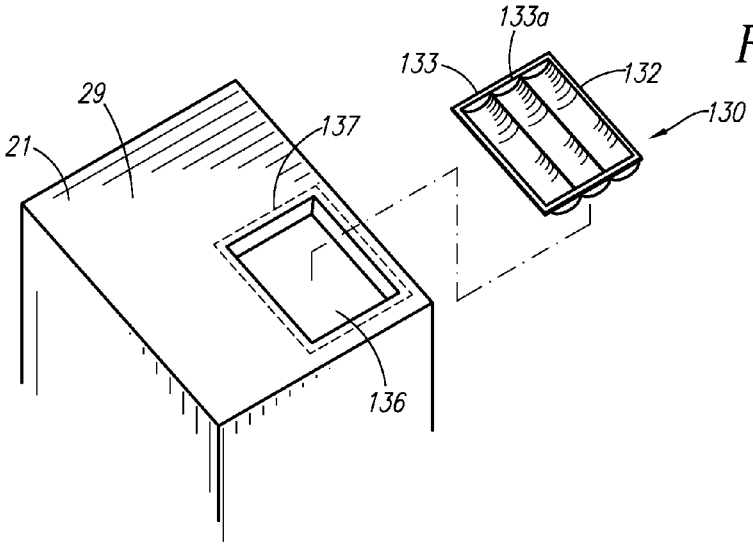
FIG. 13 is an exploded perspective view of the appliance storage and organizer device illustrating removable attachment of a plurality accessory retainer channels to one of the walls of the appliance storage and organizer device, according to one embodiment of the present invention.

Alternatively, in reference to FIG. 13, the plurality of accessory retainer channels 130 may be molded as a unitary mold 132 adapted to be received within a mold mortise 136 formed in wall 21 (shown herein as top wall 29), and removably affixed thereto. The channels 130 of unitary mold 132 are defined as longitudinal recesses aligned in series. In further accordance to this embodiment, the unitary mold 132 includes a perimeter 133 defining an outwardly extending lip 133*a* providing a support ledge for engaging an upper surface of wall 21 (top wall 29) defined as a perimeter 137 of mold mortise 136, and thereby allowing the plurality of accessory retainer channels 130 to be supported by wall 21 (top wall 29). The unitary mold 132 includes a base 134 which is received by mold mortise 136 in a frictional-fit type manner, thereby detachably affixing the plurality of accessory retainer channels 130 to wall 21 (top wall 29).

Figure 14:
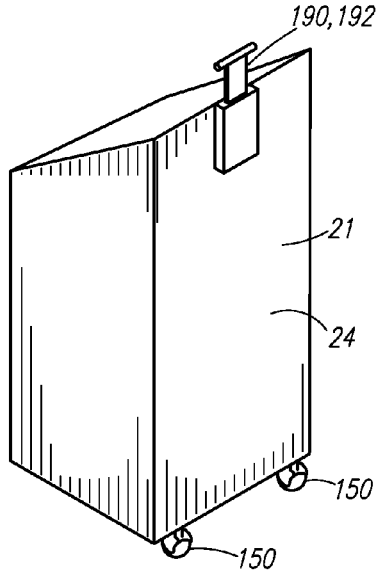
FIG. 14 is a left, rear perspective view of the appliance storage and organizer device shown mounted with a plurality of coasters and a telescopic handle, according to one embodiment of the present invention.
Figure 15:
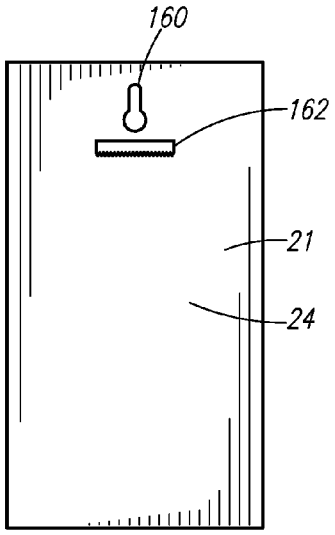
FIG. 15 is a bottom plan view of the appliance storage and organizer device illustrating means for attaching the device to a vertical surface, according to one embodiment of the present invention.

Referring now to FIGS. 14-15, in accordance to yet another embodiment, the device 10 of the present invention may comprise a plurality casters 150 connected to at least one wall 21 of the plurality of walls 21. Preferably, casters 150 are connected to opposing bottom corner edges of rear wall 24, as shown in FIG. 14.

The device 10 of the present invention may be attached to a vertical surface, such as a wall (not shown), via passage of a fastener (not shown) through an elongated void 160 defined through a wall 21 of the enclosure 21*a*, and preferably through the elongated void 160 defined through rear wall 24, as illustrated in FIG. 15. Alternatively, a bracket device 162 may be mounted to the rear wall 24 of enclosure 21*a* to facilitate attachment of the device 10 to a wall.

The device 10 of the present invention may include a handle 190 suitably mounted to one of the plurality of walls 21 of enclosure 21*a*, wherein handle 190 is preferably a telescopic handle 192.

Figure 16:
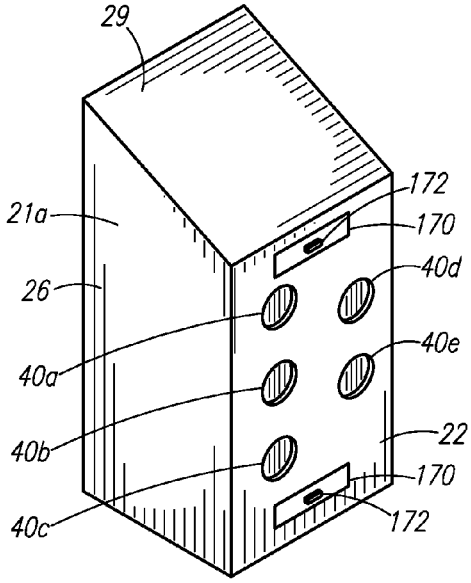
FIG. 16 is a right, frontal perspective view of the appliance storage and organizer device shown with a pair of drawers, in accordance to one embodiment of the present invention FIG. 17 a right, frontal perspective view of the appliance storage and organizer device shown with an electrical outlet, in accordance to one embodiment of the present invention.

Referring now to FIG. 16, the device 10 of the present invention may include at least one drawer 170 adapted and configured to be slidably opened/withdrawn from enclosure 21*a* and closed/inserted into enclosure 21*a* and into hollow interior 30 without coming into contact with other device 10 elements, particularly, the holes 40, hoods 50, and cord storage and retractor mechanism(s) 70. The at least one drawer 170 is positioned between the upper edge 22*a* of front wall 22 and hole 40*a* and/or between hole 40*c* and a lower edge of front wall 22. The at least one drawer 170 preferably includes a handle 172.

Figure 17:
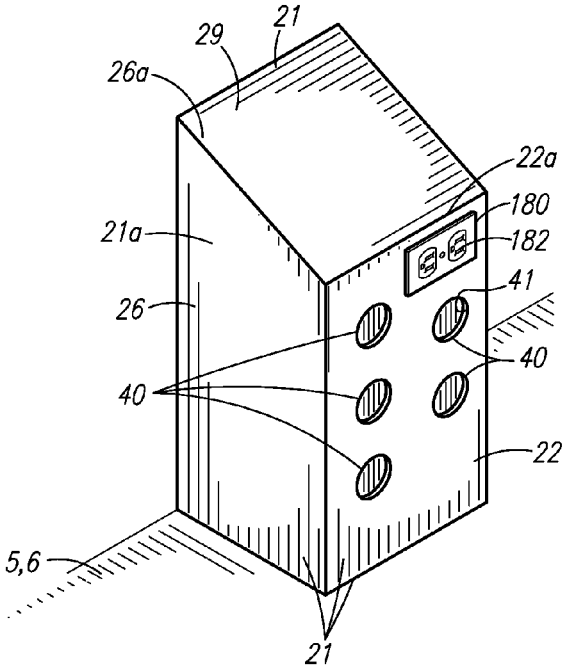
Figure 18:
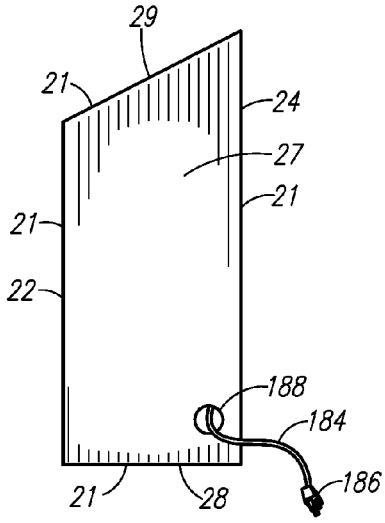
FIG. 18 is a left side elevational view of the appliance storage and organizer device illustrating an opening through which the power cord and power cord plug of the electrical outlet extends, according to one embodiment of the present invention.

Referring now more specifically to FIGS. 17-18, at least one electrical outlet 180 is provided, wherein each outlet 180 is electrically connected to a power cord 184 and power cord plug 186, the plug 186 is receivable within a standard electrical wall outlet (not shown) in order to electrically couple the at least one electrical outlet 180 to a source of electrical power. The at least one electrical outlet 180 is mounted to one of the plurality of walls 21 of enclosure 21*a*. In accordance to an exemplary embodiment, the at least one electrical outlet 180 is mounted to the front wall 22 of enclosure 21*a*.

Each outlet 180 includes at least one female receptacle 182 for receiving an electrical plug 63*a* of an appliance 60. The at least one electrical outlet 180 incorporates ground fault interrupter (GFI) circuitry (not shown) to protect against electrical shock.

The power cord 184 and power cord plug 186 extend outwardly from the hollow interior 30 of enclosure 21*a* through an opening 188 in a wall 21 of enclosure 21*a*. In accordance to an exemplary embodiment illustrated in FIG. 18, second end wall 27 is provided with the opening 188 through which power cord 184 and plug 186 extend.

It is envisioned that the various embodiments, as separately disclosed, are interchangeable in various aspects, so that elements of one embodiment may be incorporated into one or more of the other embodiments, and that specific positioning of individual elements may necessitate other arrangements not specifically disclosed to accommodate performance requirements or spatial considerations.

It is to be understood that the embodiments and claims are not limited in its application to the details of construction and arrangement of the components set forth in the description and illustrated in the drawings. Rather, the description and the drawings provide examples of the embodiments envisioned, but the claims are limited to the specific embodiments. The embodiments and claims disclosed herein are further capable of other embodiments and of being practiced and carried out in various ways. Also, it is to be understood that the phraseology and terminology employed herein are for the purposes of description and should not be regarded as limiting the claims.

Accordingly, those skilled in the art will appreciate that the conception upon which the application and claims are based may be readily utilized as a basis for the design of other structures, methods, and systems for carrying out the several purposes of the embodiments and claims presented in this application. It is important, therefore, that the claims be regarded as including such equivalent constructions.

Furthermore, the purpose of the foregoing Abstract is to enable the U.S. Patent and Trademark Office and the public generally, and especially including the practitioners in the art who are not familiar with patent and legal terms or phraseology, to determine quickly from a cursory inspection the nature and essence of the technical disclosure of the application. The Abstract is neither intended to define the claims of the application, nor is it intended to be limiting to the scope of the claims in any way. It is intended that the application is defined by the claims appended hereto.

What is claimed is:

1. An appliance storage and organizer device, the device comprising:

a housing comprising a plurality of walls, the plurality of walls forming an enclosure, the enclosure having a hollow interior;

at least one wall of the plurality of walls includes a plurality of holes defined therethrough, the plurality of holes being sizably configured for receiving an electrical appliance;

a means for organizing an electrical cord of an electrical appliance;

a plurality of hoods, each hood of the plurality of hoods is associated with a respective one of the plurality of holes; and a plurality of retaining posts, the plurality of retaining posts are provided in pairs, each pair of the plurality of retaining posts is suitably mounted to a lower surface of the at least one wall, each pair of the plurality of retaining posts are spaced in linear alignment and flank a perimeter, respectively, of each hole of the plurality of holes from opposing sides of the perimeter, and wherein each post of each pair of the plurality of retaining posts defines an incurvate configuration being flexibly-resilient, each pair of the plurality of retaining posts extends downwardly appositional from the lower surface of the at least one wall, each pair of the plurality of retaining posts is each configured to frictionally engage an electrical appliance housing portion of an electrical appliance as the electrical appliance housing portion is inserted through a respective selected hole of the plurality of holes, whereupon each pair of the plurality retaining posts undergoes outward flexion, thereby causing a compression force to be applied by each the pair of the plurality of retaining posts about an external circumferential sidewall of the electrical appliance housing portion, and thereby securably retaining the electrical appliance within the respective selected hole of the plurality of holes.

2. The device of claim 1, wherein the plurality of walls comprises a front wall opposing a rear wall, a first end wall opposing a second end wall, a bottom wall, and a top wall, wherein the first end wall and second end wall are joined contiguously by the front wall, rear wall, bottom wall and top wall, thereby forming the hollow interior.

3. The device of claim 2, wherein the top wall is pitched at an angle from horizontal, the first end wall and the second end wall each defines an acclivitous upper edge, respectively, when viewed from the front wall of the housing, and wherein the bottom wall is planar to facilitate balanced placement of the housing atop a horizontal surface.

4. The device of claim 1, wherein the at least one wall further includes a plurality of apertures defined therethrough, and wherein each the plurality of apertures is associated with a respective one of the plurality of holes, each the plurality of apertures being oriented adjacent, respectively, with one of the plurality of holes.

5. The device of claim 4, wherein each the plurality of holes includes a mouth providing direct passage through the hollow interior to the bottom wall.

6. The device of claim 1, wherein the at least one wall is the front wall.

7. The device of claim 4, wherein each the plurality of holes is sizably configured for receiving an appliance housing portion of an electrical appliance.

8. The device of claim 1, wherein each one of the plurality of hoods extends integrally from, or is suitably affixed to, a mouth of each respective one of the plurality of holes, thereby providing a guide support against which an appliance housing portion abuts, each one of the plurality of hoods extends angularly downward from an upper portion of each the respective mouth and into the hollow interior.

9. The device of claim 1, wherein the means for organizing an electrical cord of an electrical appliance is a cord storage and retractor mechanism.

10. The device of claim 1, wherein each hole of the plurality of holes having a respective the cord storage and retractor mechanism associated therewith.

11. The device of claim 1, wherein each one of the cord storage and retractor mechanisms is configured for retracting excess electrical cord of an electrical appliance through a respective aperture defined in the at least one wall and associated with a respective one of the plurality of holes.

12. The device of claim 1, further comprising a plurality of socket retainers.

13. The device of claim 1, wherein at least one of the plurality of walls includes an interior space having a shape and dimension for accommodating and retaining a personal article.

14. The device of claim 1, further comprising:

a plurality casters connected to at least one wall of the plurality of walls; and a handle suitably mounted to one wall of the plurality of walls.

15. The device of claim 1, further comprising at least one electrical outlet, wherein the at least one outlet is electrically connected to a power cord and a power cord plug, the power cord plug is receivable within a standard electrical wall outlet in order to electrically couple the at least one electrical outlet to a source of electrical power, the at least one electrical outlet is mounted to one of the plurality of walls.

* * * * *